US012433417B2

(12) United States Patent
Liechtenstein et al.

(10) Patent No.: US 12,433,417 B2
(45) Date of Patent: Oct. 7, 2025

(54) ADJUSTABLE MATTRESS FRAME AND A METHOD FOR ADJUSTING THE FRAME

(71) Applicant: POLYRON ZIKIM ACH LTD, Kibbutz Zikim (IL)

(72) Inventors: Yitzhak Liechtenstein, Zichron Ya'acov (IL); Nir Hertzman, Zichron Ya'acov (IL)

(73) Assignee: POLYRON ZIKIM ACH LTD, Kibbutz Zikim (IL)

( * ) Notice: Subject to any disclaimer, the term of this patent is extended or adjusted under 35 U.S.C. 154(b) by 328 days.

(21) Appl. No.: 17/927,537

(22) PCT Filed: Jun. 3, 2020

(86) PCT No.: PCT/IL2020/050616

§ 371 (c)(1),
(2) Date: Nov. 23, 2022

(87) PCT Pub. No.: WO2021/245641

PCT Pub. Date: Dec. 9, 2021

(65) Prior Publication Data

US 2023/0346130 A1 Nov. 2, 2023

(51) Int. Cl.
*A47C 20/04* (2006.01)
*A47C 20/08* (2006.01)

(52) U.S. Cl.
CPC ..... *A47C 20/04* (2013.01); *A47C 20/08* (2013.01)

(58) Field of Classification Search
CPC ..... A47C 20/04; A47C 20/08; A47C 20/041; A61G 7/018; A61G 7/0755; A61G 7/072; A61G 7/015
USPC ..... 5/618
See application file for complete search history.

(56) References Cited

U.S. PATENT DOCUMENTS 1,886,308 A * 11/1932 Schultes ..... A47C 7/405 297/285
2,652,826 A * 9/1953 Kallmeyer ..... A61H 9/0078 601/134
3,510,886 A * 5/1970 Benoit ..... A61G 7/002 5/616
3,877,750 A * 4/1975 Scholpp ..... A47C 1/143 297/284.3
4,164,356 A * 8/1979 Knight ..... A47C 1/028 297/1

(Continued)

FOREIGN PATENT DOCUMENTS

IL 227670 A 5/2020

OTHER PUBLICATIONS

PCT International Search Report for International Application No. PCT/IL2020/050616, mailed Oct. 15, 2020, 9pp.

(Continued)

*Primary Examiner* — David R Hare
*Assistant Examiner* — Luke Hall
(74) *Attorney, Agent, or Firm* — The Roy Gross Law Firm, LLC; Roy D. Gross

(57) ABSTRACT

An adjustable mattress frame configured to support a human user lying thereon, the adjustable mattress frame comprises areas configured to support at least part of a body of the user, pivotally connected one to the other, as well as additional features that allow a user of the adjustable mattress frame to easily change his lying position and provide full support for the at least part of the user's body.

17 Claims, 9 Drawing Sheets

(56) References Cited

U.S. PATENT DOCUMENTS 5,173,975 A * 12/1992 Peterson ..... A61G 7/0528 5/430
5,320,410 A * 6/1994 Faiks ..... A47C 7/405 297/285
5,957,536 A * 9/1999 Sullivan ..... A47C 5/12 297/452.2
6,877,816 B1 * 4/2005 Farmont ..... A47C 31/126 297/380
7,344,197 B2 * 3/2008 Sanderson ..... F16G 13/16 5/722
7,905,846 B2 * 3/2011 Ganti ..... A61H 23/006 601/103
9,084,476 B2 * 7/2015 Mojtabavi ..... A47B 96/202
9,848,709 B2 * 12/2017 Molenda ..... A47C 7/725
10,016,059 B2 * 7/2018 Leonard ..... A47C 7/28
10,682,272 B2 * 6/2020 Bellingroth ..... A47C 20/041
11,820,258 B2 * 11/2023 Bahr ..... A47C 3/021
2003/0093862 A1 * 5/2003 Hanson ..... A61G 7/015 5/613
2004/0064891 A1 * 4/2004 Horitani ..... A47C 20/08 5/618
2004/0215113 A1 * 10/2004 Saringer ..... A61G 7/0573 601/103
2005/0120481 A1 * 6/2005 Farmont ..... A47C 20/041 5/613
2006/0061195 A1 * 3/2006 Snyders ..... A47C 3/029 297/452.63
2006/0143827 A1 * 7/2006 Wilming ..... A47C 20/08 5/618
2009/0178201 A1 * 7/2009 Lujan ..... A61G 7/07 5/630
2014/0325759 A1 * 11/2014 Bly ..... A61G 7/015 5/613
2017/0202364 A1 * 7/2017 Ohno ..... A61G 7/057

OTHER PUBLICATIONS

PCT Written Opinion for International Application No. PCT/IL2020/050616, mailed Oct. 15, 2020, 5pp.

* cited by examiner

ADJUSTABLE MATTRESS FRAME AND A METHOD FOR ADJUSTING THE FRAME

CROSS REFERENCE TO RELATED APPLICATIONS

This application is a National Phase of PCT Patent Application No. PCT/IL2020/050616 having International filing date of Jun. 3, 2020, the contents of which are all incorporated herein by reference in their entirety.

FIELD

The present subject matter relates to sleep furniture, especially mattresses. More particularly, the present subject matter relates to adjustable mattress frames.

BACKGROUND

Adjustable beds that allow changing the lying position of a user have become popular in recent years due to the comfort and health advantages they provide. The current adjustable beds include an adjustment mechanism that includes heavy motors and a durable heavy frame, rendering the adjustable beds too heavy and cumbersome for maintenance and mobility. In addition, the current adjustable beds require usage of a designated mattress that is suitable for bending. Furthermore, the variety of lying postures that can achieved with the currently available adjustable beds is limited to merely erection of the back towards a straight sitting position, and lifting of the legs. Thus, even though the current adjustable beds provide additional lying position options compared to classic straight beds, there is still place for improvement in terms of comfort and ergonomics. In addition to, and because of the aforementioned drawbacks, the cost of manufacturing, shipping and installment of the current adjustable beds is relatively high.

SUMMARY

Unless otherwise defined, all technical and scientific terms used herein have the same meaning as commonly understood by one of ordinary skill in the art to which this subject matter belongs. Although methods and materials similar or equivalent to those described herein can be used in the practice or testing of the present subject matter, suitable methods and materials are described below. In case of conflict, the patent specification, including definitions, will control. In addition, the materials, methods, and examples are illustrative only and not intended to be limiting.

According to one aspect of the present subject matter, there is provided an adjustable mattress frame configured to support a human user lying on the adjustable mattress frame, the adjustable mattress frame comprising:

a lower back area configured to support a lower back of the user, and be in contact with a surface on which the adjustable mattress frame placed; and either an upper area configured to support an upper part of a body of the user, pivotally connected to the lower back area; or a legs area configured to support legs of the user pivotally, pivotally connected to the lower back area; or both the upper area and the legs area, wherein the upper area comprises: a head area configured to support a head of the user, pivotally connected to a back area configured to support a back of the user, pivotally connected to the lower back area, and wherein the legs area comprises: a thighs area configured to support thighs of the user, pivotally connected to the lower back area, and a shins area configured to support shins of the user, pivotally connect to the thighs area, wherein a pivot area between the thighs area and the shins area is a knees area configured to support knees of the user, and wherein the adjustable mattress frame further comprises at least one angle changer movably attached to the areas of the adjustable mattress frame, and configured to change its length, thereby configured to change an angle between two adjacent areas.

According to one embodiment, the angle changer is a back and head cable fixedly attached to the head area, and movably attached to the back area, and further attached to a back and head adjuster positioned in the lower back area, and configured to change the length of the back and head cable, wherein changing the length of the back and head cable changes an angle between the head are and the back area, and an angle between the back area and the lower back area.

According to another embodiment, the angle changer is a legs cable fixedly attached to the shins area, and movably attached to the thighs area, and further attached to a legs adjuster positioned in the lower back area, and configured to change the length of the legs cable, wherein changing the length of the legs cable changes an angle between the shins area and the thighs area, and an angle between the thighs area and the lower back area.

According to yet another embodiment:

the head area comprises multiple elongated pivotally connected head links, wherein a length of the head link determines a width of the head area;

the back area comprises multiple elongates pivotally connected back links, wherein a length of the back link determines a width of the back area;

the thighs area comprises multiple elongated pivotally connected thighs links, wherein a length of the thighs links determines a width of the thighs area;

the shins area comprises multiple elongated pivotally connected shins link, wherein a length of the shins link determines a width of the shins area;

and wherein the at least one angle changer is movably attached to the links, and configured to change its length, thereby configured to change an angle between two adjacent links.

According to still another embodiment, the angle changer is a back and head cable fixedly attached to a head link, movably attached to other head links, movably attached to back links, and further attached to a back and head adjuster positioned in the lower back area, and configured to change the length of the back and head cable, wherein changing the length of the back and head cable changes an angle between two adjacent head links, and an angle between the head area and the back area, and an angle between two adjacent back links, and an angle between the back area and the lower back area.

According to a further embodiment, the angle changer is a legs cable fixedly attached to a shins link, movably attached to other shins links, movably attached to thighs links, and further attached to a back and head adjuster positioned in the lower back area, and configured to change the length of the legs cable, wherein changing the length of the legs cable changes an angle between two adjacent shins links, and an angle between the shins area and the thighs area, and an angle between two adjacent thighs links, and an angle between the thighs area and the lower back area.

According to yet a further embodiment, the angle changer is movably attached to two adjacent links, and is configured to change its length, thereby configured to change an angle between the two adjacent links.

According to still a further embodiment, every two links are movably attached with an angle changer.

According to an additional embodiment, every angle changer is independent of any other angle changer, thereby allowing changing an angle between any two adjacent links differently of any other two adjacent links.

According to another additional embodiment, the adjustable mattress frame further comprising a cover configured to cover the adjustable mattress frame.

According to yet another embodiment, the cover is configured to change its shape according to a shape of the adjustable mattress frame.

According to still another embodiment, the cover is configured to withstand pressure of a user that lies on the cover, and withstand possible damage by sharp parts of the adjustable mattress frame.

According to a further embodiment, the cover is movably attached to the links.

According to yet a further embodiment, the cover comprises multiple cover connectors, and wherein each cover connector is configured to pivotally attach to a link.

According to another aspect of the present subject matter, there is provided an adjustable mattress comprising an inner adjustable mattress frame as described above.

According to one embodiment, the adjustable mattress frame of the adjustable mattress is covered with a padding material.

According to another embodiment, the padding material is configured to change its shape according to a shape of the adjustable mattress frame.

BRIEF DESCRIPTION OF THE DRAWINGS

Embodiments are herein described, by way of example only, with reference to the accompanying drawings. With specific reference now to the drawings in detail, it is stressed that the particulars shown are by way of example and for purposes of illustrative discussion of the preferred embodiments, and are presented in the cause of providing what is believed to be the most useful and readily understood description of the principles and conceptual aspects of the embodiments. In this regard, no attempt is made to show structural details in more detail than is necessary for a fundamental understanding, the description taken with the drawings making apparent to those skilled in the art how several forms may be embodied in practice.

In the drawings.

DESCRIPTION OF THE PREFERRED EMBODIMENTS

Figure 1:
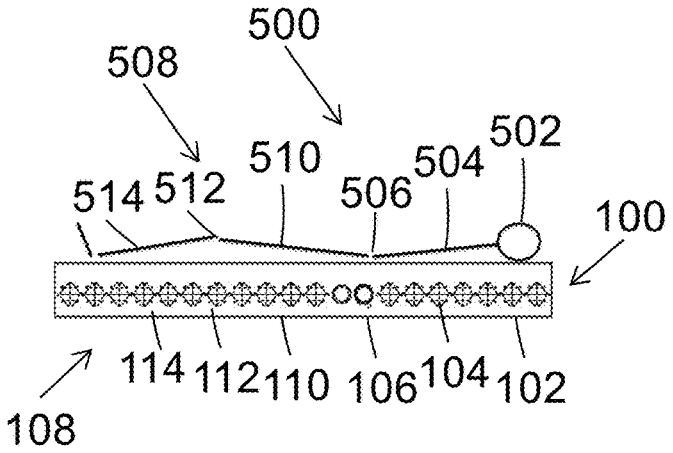
FIG. 1 schematically illustrates, according to some exemplary embodiments, a side view of an adjustable mattress frame, and a human user lying on the adjustable mattress frame.

Before explaining at least one embodiment in detail, it is to be understood that the subject matter is not limited in its application to the details of construction and the arrangement of the components set forth in the following description or illustrated in the drawings. The subject matter is capable of other embodiments or of being practiced or carried out in various ways. Also, it is to be understood that the phraseology and terminology employed herein is for the purpose of description and should not be regarded as limiting. In discussion of the various figures described herein below, like numbers refer to like parts. The drawings are generally not to scale.

For clarity, non-essential elements were omitted from some of the drawings.

In one aspect, the present subject matter provides an adjustable mattress frame. In another aspect, the present subject matter provides a mattress comprising an adjustable mattress frame. In yet another aspect, the present subject matter provides a method for adjusting the adjustable mattress frame. Advantages of the adjustable mattress frame over the currently available solutions for changing the lying position of a user, would become evident during the description of the present subject matter.

Referring now to FIG. 1, schematically illustrating, according to an exemplary embodiment, a side view of an adjustable mattress frame, and a human user lying on the adjustable mattress frame. Parts of a body of the human user 500 that are relevant to the present subject matter, and illustrated in FIG. 1, include a head 502, a back 504, a lower back 506, and legs 508, when the legs 508 include thighs 510, knees 512, and shins 514. The adjustable mattress frame 100 includes areas that correspond to the parts of the body of the human user 500. Thus, according to one embodiment, the adjustable mattress frame 100 comprises: a lower back area 106 configured to support a lower back 506 of the user 500, and either an upper area configured to support an upper part of body of user pivotally connected to the lower back area 106, or a legs area 108 configured to support legs of a user pivotally connected to the lower back area 106, or both an upper area and a legs area 108.

The upper area comprises a head area 102 configured to support a head 502 of a user 500, pivotally connected to a back area 104 configured to support a back 504 of the user 500, pivotally connected to the lower back area 106.

The legs area 108 comprises a thighs area 110 configured to support thighs 510 of the user 500 pivotally connected to the lower back area 106, and a shins area 114 configured to support shins 514 of the user 500 and pivotally connected to the thighs area 110, when a pivot area between the thighs area 110 and the shins area 114 is a knees area 112 configured to support knees 512 of the user 500.

Figure 2A:
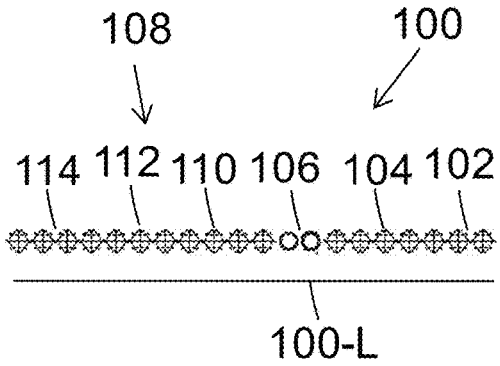
FIG. 2A-E schematically illustrate, according to some exemplary embodiments, a side view of an adjustable mattress frame in various positions.
Figure 2B:
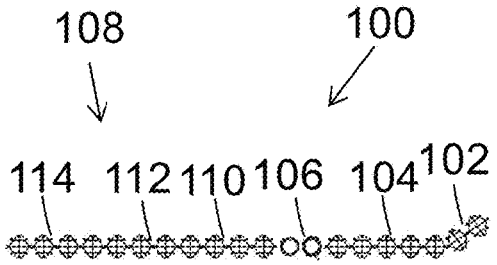
Figure 2C:
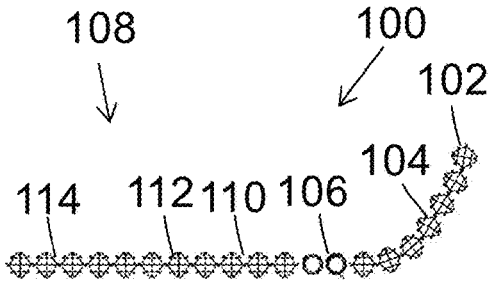
Figure 2D:
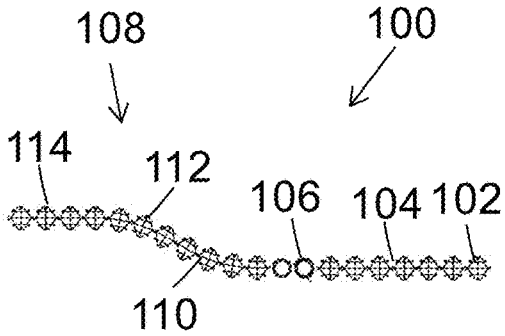
Figure 2E:
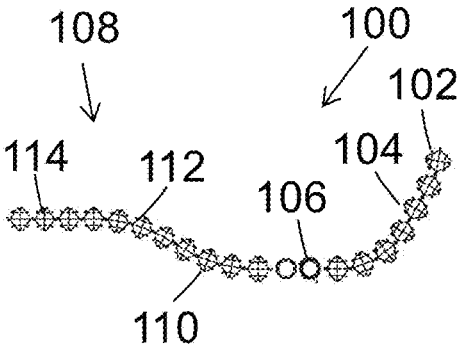

Referring now to FIGS. 2A-E, schematically illustrating, according to some exemplary embodiments, a side view of an adjustable mattress frame in various positions. According to one embodiment, the adjustable mattress frame 100 is configured to adjust to a variety of different positions that determine different lying positions of the user 500. Some exemplary positions are illustrated in FIGS. 2A-E. FIG. 2A illustrates an adjustable mattress frame 100 in a full horizontal position, when all the area of the adjustable mattress frame 100 are horizontal. FIG. 2B illustrates an adjustable mattress frame 100 in an elevated head position, when the head area 102 is elevated. FIG. 2C illustrates an elevated back and head position, when the head area 102 and the back area 104 are elevated. FIG. 2D illustrates an elevated legs position, when the legs area 108 is elevated. It should be noted that elevation of the legs area 108 is achieved by elevations of the knees area 112. As a result, the thighs area 110 and the shins area 114 are elevated as well. The adjustable mattress frame 102 is also configured to adjust to any combination of the aforementioned positions, for example the combination illustrated in FIG. 2E. FIG. 2E illustrates an elevated head and back and elevated legs position.

Returning now to FIG. 2A. According to one embodiment, the adjustable mattress frame has a length 100-L, which is the distance between an edge of the head area 102 and an edge of the shins area 114. Thus, the adjustable mattress frame 100 is configured to allow a user 500 to normally lie along the length 100-L of the adjustable matter frame 100.

Figure 3:
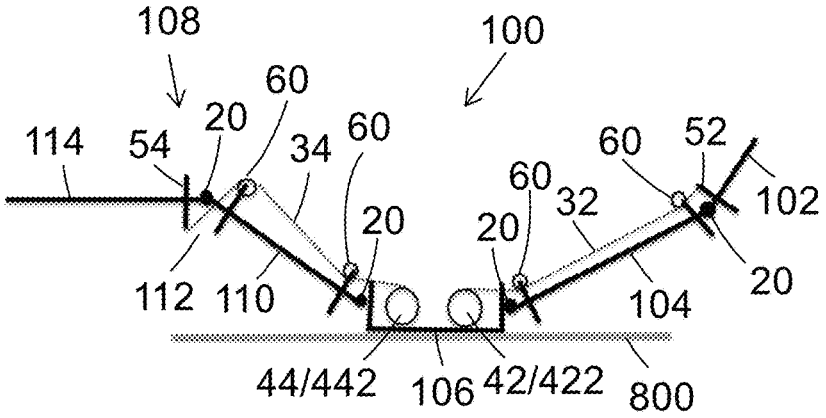
FIG. 3 schematically illustrates, according to some exemplary embodiments, a side view of components of an adjustable mattress frame.

Referring now to FIG. 3 illustrating, according to an exemplary embodiment, a side view of components of an adjustable mattress frame. According to one embodiment, the adjustable mattress frame 100 comprises a plurality of hinges 20 configured to pivotally connect the areas of the adjustable mattress frame 100. Thus, a hinge 20 pivotally connects the head area 102 with the back area 104, a hinge 20 pivotally connects the back area 104 with the lower back area 106, a hinge 20 pivotally connects the lower back area 106 with the thighs area 110, and a hinge 20 at the knees area 112 that pivotally connects the thighs area 110 with the shins area 114.

As can be seen in FIG. 3, according to one embodiment, the adjustable mattress frame 100 comprises at least one back and head cable 32 attached to the back area 104 and the head area 102, and a back and head adjuster 42 configured to change a length of the back and head cable 32, thereby either adjusting a position of the head area 102, or adjusting the position of the back area 104 and the head area 102. In other words, changing of the length of the back and head cable 32 can adjust the position of the head area 102 and the back area 104, by changing an angle between the head area 102 and the back area 104, and an angle between the back area 104 and a lower back area.

As can be further seen in FIG. 3, the at least one back and head cable 32 is fixedly attached to the head area 102. The back and head cable 32 is fixedly attached to the head area 102, for example by welding (a metal cable), adhering and the like. In another example, the back and head cable 32 is fixedly attached to a head anchor 52 that is attached to the head area 102. In addition, the back and head cable 32 is movably attached to the back area 104 in a manner that allows movement of the back and head cable 32 relative to the back area 104. For example, as illustrated in FIG. 3, the back and head cable 32 is attached to at least one pulley block 60 that is attached to the back area 104. According to one embodiment, the back and head cable 32 is attached to two pulley blocks 60 attached to the back area 104. According to another embodiment, a pulley block 60 is attached adjacent to an edge of the back area 104 that is pivotally connected to the head area 102, and another pulley block 60 is attached adjacent to an edge of the back area 104 that is pivotally connected to the lower back area 106. The orientation of the back and head cable 32 in relation to the back area 104 and the head area 102 that allow adjustments of the back area 104 and the head area 102 is discussed hereinafter.

As can be further seen in FIG. 3, the back and head adjuster 42 is attached to the back and head cable 32 in a manner that allows changing a length of the back and head cable 32. Thus, one edge of the back and head cable 32 is fixedly attached to the head area 102, another edge of the back and head cable 32 is attached to the back and head adjuster 42 in a manner that allows changing a length of the back and head cable 32, and the back and head cable 32 itself is movably attached to the back area 104.

According to one embodiment, the back and head adjuster 42 is configured to change the length of the back and head cable 32. An exemplary embodiment of the back and head adjuster 42 is a rotor, while the back and head cable 32 is configured to wrap around the back and head rotor 422. Thus, occasionally, when relevant, the back and head adjuster 42 will be designated "back and head rotor 422". According to one embodiment, the back and head rotor 422 is configured to rotate in one direction, for example clockwise, and in an opposite direction, for example counterclockwise. When the back and head rotor 422 rotates in one direction the back and head cable 32 can wrap around the back and head rotor 422, thereby decreasing the length of the back and head cable 32 between the back and head rotor 422 and the edge of the back and head cable 32 that is attached to the head area 102. On the other hand, when the back and head rotor 422 rotates in an opposite direction part of the back and head cable 32 that is wrapped around the back and head rotor 422 can be released, thereby increasing the length of the back and head cable 32 between the back and head rotor 422 and the edge of the back and head cable 32 that is attached to the head area 102.

According to one embodiment, changing the length of the back and head cable 32 adjusts the position of either the head area 102, or the head area 102 and the back area 104. When the length of the back and head cable 32 decreases, either the head area 102, or the head area 102 and the back area 104 are elevated, while when the length of the back and head cable 32 increases, either the head area 102, or the head area 102 and the back area 104 are lowered. This embodiment is achieved due to the fixation of an edge of the back and head cable 32 to the head area 102, and the movable attachment of the back and head cable 32 to the back area 104, as well as because of the pivotal connected between the head area 102, the back area 104, and the lower back area 106, in which the back and head adjuster 42 is placed.

As can be further seen in FIG. 3, according to one embodiment, the back and head cable 32 is fixedly attached to a head anchor 52 that is attached to an upper side of the head area 102. According to another embodiment, the back and head cable 32 is movably attached to an upper side of the back area 104. For example, the back and head cable 32 is attached to at least one pulley block 60 that is attached to an upper side of the back area 104.

As can be further seen in FIG. 3, according to one embodiment, the adjustable mattress frame 100 comprises at least one legs cable 34 attached to the back area legs area 108, and a legs adjuster 44 configured to change a length of the legs cable 34, thereby adjusting a position of the legs area 110. In other words, changing of the length of the legs cable 34 can adjust the position of the legs area 110. It should be noted that even though FIG. 3 illustrates an adjustable mattress frame 100 comprising at least one back and head cable 32 and at least one legs cable 34, as well as at least one back and head adjuster 42 and at least one legs adjuster 44, this FIG. should be considered as exemplary only and not limit the scope of the present subject matter, according to which, the adjustable mattress frame comprises either the aforementioned components that relate to the back area 104 and head area 102, or the components that relate to the legs area 108, or both.

As can be further seen in FIG. 3, the at least one legs cable 34 is fixedly attached to the shins area 114, for example by welding (a metal cable), adhering and the like. In another example, the legs cable 34 is fixedly attached to a shins anchor 54 that is attached to the shins area 114. In addition, the legs cable 34 is movably attached to the thighs area 110 in a manner that allows movement of the legs cable 34 relative to the thighs area 110. For example, as illustrated in FIG. 3, the legs cable 34 is attached to at least one pulley block 60 that is attached to the thighs area 110. According to one embodiment, the legs cable 34 is attached to two pulley blocks 60 attached to the thighs area 110. According to another embodiment, a pulley block 60 is attached adjacent to the knees area 112, and another pulley block 60 is attached adjacent to an edge of the thighs area 110 that is pivotally connected to the lower back area 106. The orientation of the legs cable 34 in relation to the legs area 108 that allow adjustments of the legs area 108 is discussed hereinafter.

As can be further seen in FIG. 3, the legs adjuster 44 is attached to the legs cable 34 in a manner that allows changing a length of the legs cable 34. Thus, one edge of the legs cable 34 is fixedly attached to the shins area 114, another edge of the legs cable 34 is attached to the legs adjuster 44 in a manner that allows changing a length of the legs cable 34, and the legs cable 34 itself is movably attached to the thighs area 110.

According to one embodiment, the legs adjuster 44 is configured to change the length of the legs cable 34. An exemplary embodiment of the legs adjuster 44 is a rotor, while the legs cable 34 is configured to wrap around the legs rotor 442. Thus, occasionally, when relevant, the legs adjuster 44 will be designated "legs rotor 442". According to one embodiment, the legs rotor 442 is configured to rotate in one direction, for example clockwise, and in an opposite direction, for example counterclockwise. When the legs rotor 442 rotates in one direction the legs cable 34 can wrap around the legs rotor 442, thereby decreasing the length of the legs cable 34 between the legs rotor 442 and the edge of the legs cable 34 that is attached to the shins area 114. On the other hand, when the legs rotor 442 rotates in an opposite direction part of the legs cable 34 that is wrapped around the legs rotor 442 can be released, thereby increasing the length of the legs cable 34 between the legs rotor 442 and the edge of the legs cable 34 that is attached to the shins area 114.

According to one embodiment, changing the length of the legs cable 34 adjusts the position of legs area 108. When the length of the legs cable 34 decreases, the legs area 108 is elevated, while when the length of the legs cable 34 increases, the legs area 108 is lowered. This embodiment is achieved due to the fixation of an edge of the legs cable 34 to the shins area 114, and the movable attachment of the legs cable 34 to the thighs area 110, as well as because of the pivotal connected between the shins area 114, the thighs area 110, and the lower back area 106, in which the legs adjuster 44 is placed.

As can be further seen in FIG. 3, according to one embodiment, the legs cable 34 is fixedly attached to a shins anchor 54 that is attached to a lower side of the shins area 114. According to another embodiment, the legs cable 34 is movably attached to an upper side of the thighs area 110. For example, the legs cable 34 is attached to at least one pulley block 60 that is attached to an upper side of the thighs area 110. However, in the knees area 112, the legs cable 34 changes its orientation relative to the legs area 108, and shifts from attachment to an upper side of the thighs area 110 to a lower side of the shins area 114, namely, as mentioned above, the legs cable 34 is fixedly attached to the lower side of the shins area 114. This embodiment allow bending of the legs area 108 at the knees area 112 in a manner the elevates the thighs area 110 while keeping the shins area 114 substantially horizontal, or even bent downwards, when the length of legs cable 34 is shortened.

According to one embodiment, illustrated in FIG. 3, either the back and head adjuster 42, or the legs adjuster 44, or the back and head adjuster 42 and the legs adjuster 44, is placed in the lower back area 106. Thus, the lower back area 106 cannot be adjusted, namely the lower back area 106 is fixed and cannot be elevated or lowered during adjustment of the adjustable mattress frame 104. In addition, according to another embodiment, the lower back area 106 serves as a basis of the adjustable mattress frame 100 that is configured to be placed on a surface 800. In other words, the lower back area 106 is configured to be in permanent contact with a surface 800, for example a floor, a bed, and the like.

Figure 4:
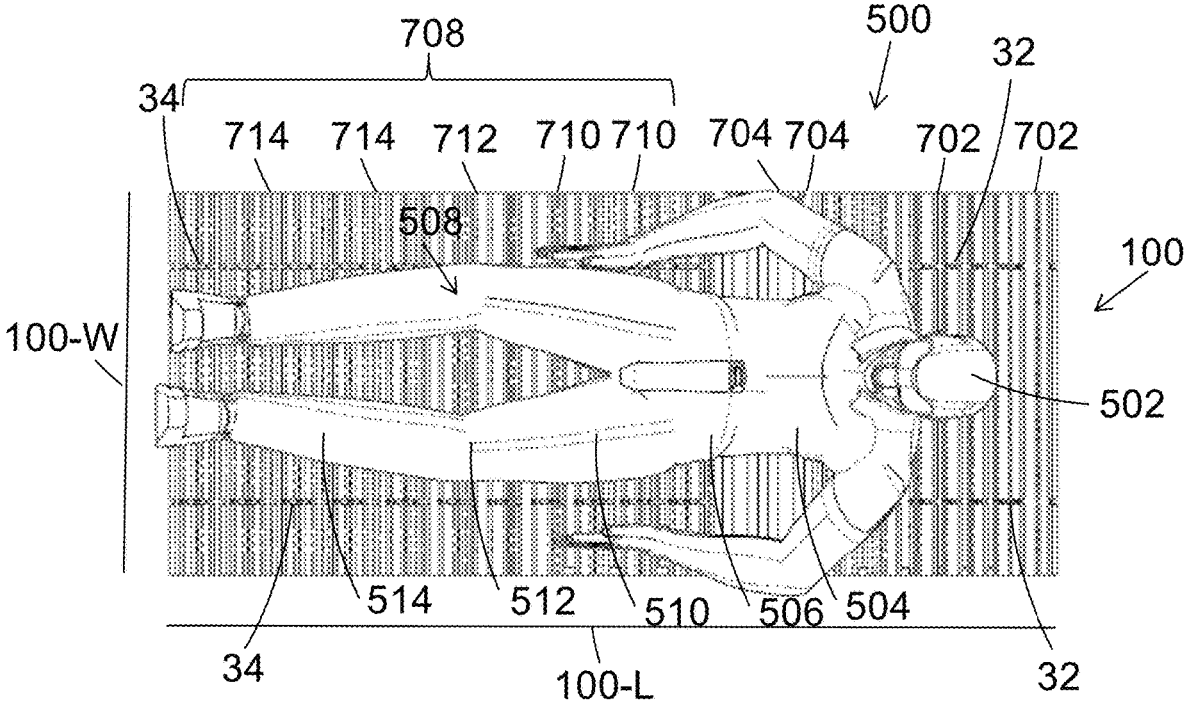
FIG. 4 schematically illustrates, according to some exemplary embodiments, an upper view of an adjustable mattress frame further comprising multiple links, and a human user lying on the adjustable mattress frame.

Referring now to FIG. 4, schematically illustrating an upper view of an adjustable mattress frame further comprising multiple links, and a human user lying on the adjustable mattress frame. The adjustable mattress frame 100 has a length 100-L as described above, and a width 100-W. FIG. 4 illustrates an adjustable mattress frame 100 comprising multiple pivotally connected elongated links.

According to one embodiment, the head area 102 comprises multiple pivotally connected elongated head links 702, when the lengths of the head links 704 determine the width 100-W of the head area 102; and the back area 102 comprises multiple pivotally connected elongated back links 704, when the lengths of the back links 704 determine the width 100-W of the back area 104.

Figure 5:
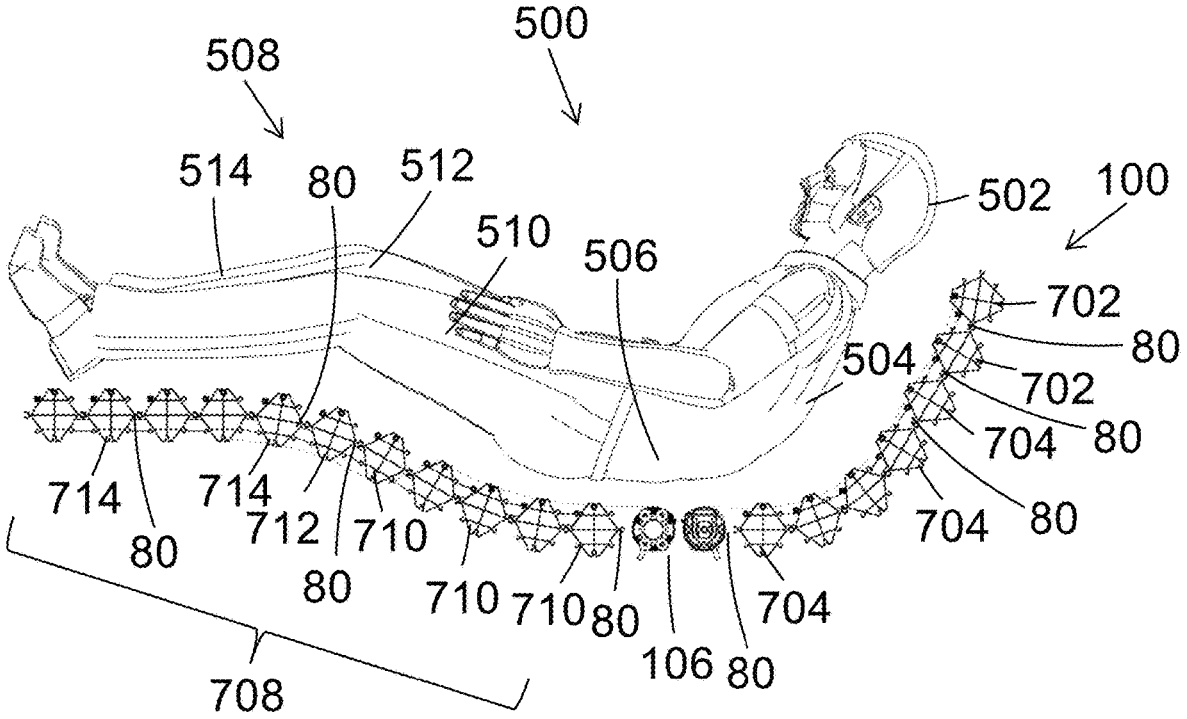
FIG. 5 schematically illustrates, according to some exemplary embodiments, a side view of an adjustable mattress frame further comprising multiple links, and a human user lying on the adjustable mattress frame.

Referring now to FIG. 5, schematically illustrating a side view of an adjustable mattress frame further comprising multiple links, and a human user lying on the adjustable mattress frame. FIG. 5 illustrates the pivotally connected head links 702 and the pivotally connected back links 704, for example by using a flexible element that connects adjacent links. According to a preferred exemplary embodiment, the adjacent links are pivotally interconnected with a link hinge 80.

In addition, as described above, the head area 102 is pivotally connected to the back area 104. This is achieved by the embodiment, illustrated in FIG. 5, of a head link 702 that is pivotally connected to an adjacent back link 704. Additionally, as described above, the back area 104 is pivotally connected to the lower back area 106. This is achieved by the embodiment of a back link 704 pivotally connected to the lower back area 106.

Returning now to FIG. 4, the head links 702 and the back links 704 are interconnected with the at least one back and head cable 32 according to embodiments described above, while the length of the back and head cable 32 can be changed by the aforementioned back and head adjuster 42.

Referring now to FIG. 4. According to one embodiment, the thighs area 110 comprises multiple pivotally connected elongated thighs links 710, when the lengths of the thighs links 710 determine the width 100-L of the thighs area 110; and the shins area 114 comprises multiple pivotally connected elongated shins links 714, when the lengths of the shins links 714 determine the width 100-L of the shins area 114.

Returning now to FIG. 5, illustrating the pivotally connected thighs links 710, the pivotally connected knees links 712, and the pivotally connected shins links 714, for example by using a flexible element that connected adjacent links. According to a preferred exemplary embodiment, the adjacent links are pivotally interconnected with a link hinge 80.

In addition, as described above, the shins area 114 is pivotally connected to the knees area 112. This is achieved by the embodiment, illustrated in FIG. 5, of a shins link 714 that is pivotally connected to an adjacent knees link 712. Similarly, the knees area 112 is pivotally connected to the thighs area 110. This is achieved by the embodiment of a knees link 712 that is pivotally connected to an adjacent thighs link 710. Additionally, as described above, the thighs area 110 is pivotally connected to the lower back area 106. This is achieved by the embodiment of a thighs link 710 pivotally connected to the lower back area 106.

Returning now to FIG. 4, the thighs links 710, the knees links 712 and the shins links 714 are interconnected with the at least one legs cable 34 according to embodiments described above, while the length of the legs cable 34 can be changed by the aforementioned legs adjuster 44. It should be noted that occasionally, the thighs links 710, the knees links 712 and the shins links 714 would be occasionally collectively designated hereinafter "legs links 708".

Thus, according to one embodiment, the adjustable mattress frame 100 comprises multiple head links 702 and back links 704 according to the embodiments described above. According to another embodiment, the adjustable mattress frame 100 comprises multiple legs links 708 according to embodiments described above, namely thighs links 710, knees links 712 and shins links 714. According to yet another embodiment, the adjustable mattress frame comprises multiple head links 702 and back links 704, and multiple legs links 708.

As mentioned above, in relation to FIG. 3, the adjustable mattress frame 100 is configured to adjust the position of the head area 102, or adjusting the position of the back area 104 and the head area 102 by changing the length of the back and head cable 32 with the back and head adjuster 42. This embodiment pertains also to the adjustable mattress frame 100 that comprises multiple head links 702 and multiple back links 704. However, by comparing FIG. 3 with FIG. 5, one can easily recognize that the head area 102 comprising multiple head links 702, and the back area 104 comprising multiple back links 704, are configured to assume any intermediate position in terms of flexibility and curvature of the head area 102 and the back area 104. Instead of being straight plane, as illustrated in FIG. 3, the head area 102 and the back area 104 that comprise multiple links can be more curved, as seen in FIG. 5. Similarly, the legs area 108 that comprises multiple legs links 708, as illustrated in FIG. 5, can be more curved compared to the embodiments of the legs area 108 illustrated in FIG. 3. Thus, the adjustable mattress frame 100 that comprises multiple links provides a more ergonomic support to a user 500 that lies on the adjustable mattress frame, compared to the adjustable mattress frame 100 that comprises straight areas, as illustrated in FIG. 3, as well as comparted to prior art adjustable beds, in which, for example the back and head of the user are supported by a straight and stiff support to both the back and head of the user.

Another advantage of the adjustable mattress frame 100 of the present subject matter over prior art adjustable beds is that in the adjustable mattress frame 100 the position of the back area 104 and the head area 102 can be adjusted by only one back and head adjuster 42 as described above, whereas in prior art adjustable beds there is a need for a motor to adjust the position of the support for the back of the user, and when there is a desire to be able to adjust the position of the support for the head of the user, there is a need for an additional motor for adjusting the position of the support to the head. In addition, in prior art adjustable beds, there is a need for a motor as well as a cumbersome mechanism for adjusting the support for the legs of the user, whereas in the adjustable mattress frame 100 only a legs adjuster 44 and at least one legs cable 34 are needed to adjust the legs area 108, with much more flexibility and ergonomic support to the user 500. In addition, in prior art adjustable beds there is a need for heavy and cumbersome mechanisms for allowing adjustments of the bed, and accordingly strong and heavy motors for moving the parts of the adjustable bed during adjustment. On the other hand, in the adjustable mattress frame 100 only light weighted cables are needed to adjust the position of the adjustable mattress frame 100, and accordingly the back and head adjuster 42 and/or the legs adjuster 44 can be relatively weak and light weighted, not to mention much cheaper than the mechanisms and motors of prior are adjustable beds.

Figure 6:
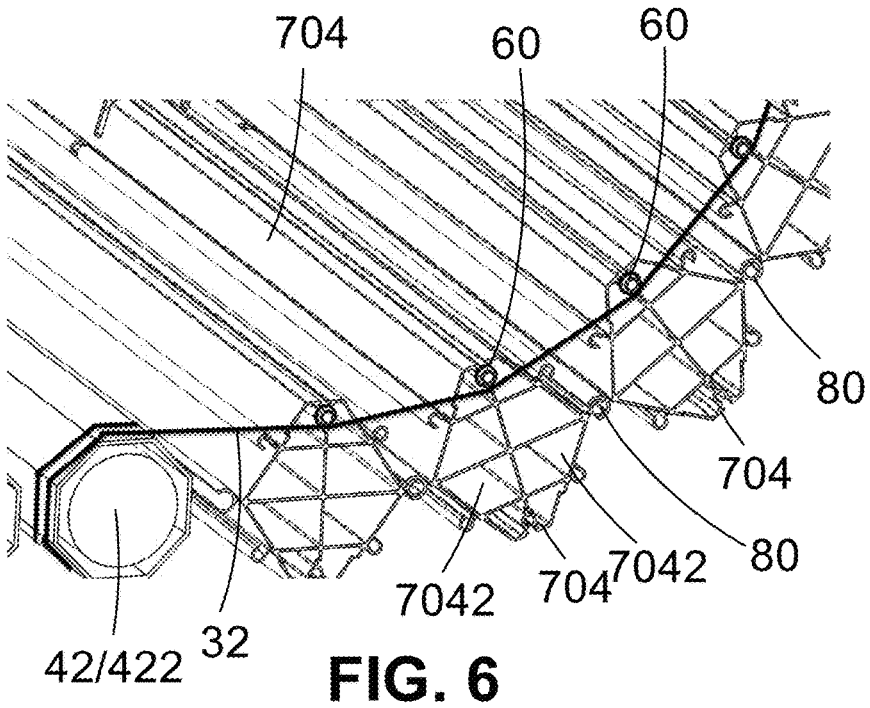
FIG. 6 schematically illustrates, according to some exemplary embodiments, a side perspective view of some back links interconnected with a back and head cable to a head and back adjuster.

Referring now to FIG. 6, schematically illustrating a side perspective view of some back links interconnected with a back and head cable to a head and back adjuster. According to one embodiment, the links are partially hollow and comprise at least one inner space. For example, a back link 704 illustrated in FIG. 6 comprises at least one inner space 7042. It should be noted that all types of links of the adjustable mattress frame 100 can comprise at least one inner space, as illustrated in FIG. 6. An advantage of this embodiment is that it allows usage of a relatively small amount of material for manufacturing the links, thus reducing costs of manufacturing the adjustable mattress frame 100. Another advantage is that the weight of the links and the overall weight of the adjustable mattress frame 100 is relatively small, compared to prior art adjustable beds, due to the spaces in the links.

Another embodiment that be clearly seen in FIG. 6 is the pivotal connection of the links one to the other, for example by a hinge 80, that as can be seen in FIG. 6 pivotally connected to adjacent back links 704.

In addition, the back and head cable 32 that interconnects the links is also illustrated in FIG. 6. According to one embodiment, the link is movably attached to the cable. For example, a back link 704 is movably attached to the back and head cable 32. Similarly, any link of the adjustable mattress frame 100 can be movably attached to its corresponding cable. According to an exemplary embodiment, illustrated in FIG. 6, a back link 704 is movably attached to the back and head cable 32 with a pulley block 60. Thus, according to one embodiment, the link further comprises a pulley block 60 that is configured to movable attach to a cable. According to one embodiment, the pulley block 60 is attached to an upper part of the back link 704 and of the head link 702. According to another embodiment, a lower part of the pulley block 60 is configured to be in contact with a cable, as can be seen in FIG. 6. As a result, in this embodiment, the back and head cable 32 is below each pulley block 60 of the back links 704. Similarly, lower parts of pulley blocks 60 of the head links 702 are also configured to be in contact with the back and head cable 32.

Figure 7:
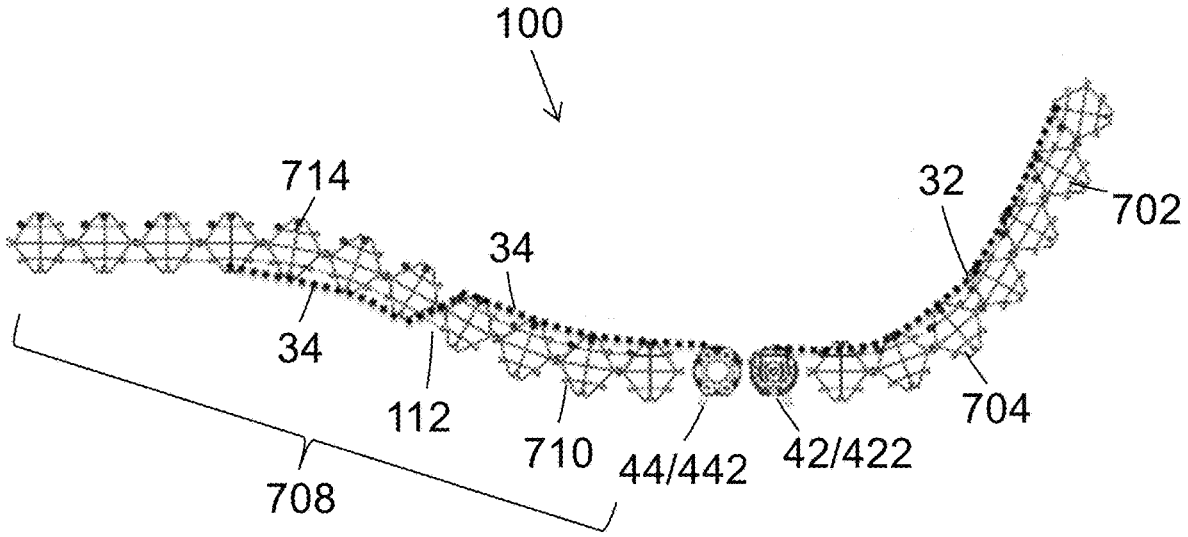
FIG. 7 schematically illustrates, according to some exemplary embodiments, a side view of an adjustable mattress frame 1 comprising a back and head cable and a legs cable.

Referring now to FIG. 7, schematically illustrating a side view of an adjustable mattress frame 1 comprising a back and head cable and a legs cable. According to one embodiment, the back and head cable 34 is attached to an upper side of the head area 102 and the back area 104, as described above in relation to FIG. 3. According to another embodiment, illustrated in FIG. 7, the back and head cable 32 is attached to upper sides of the head links 702 and to upper sides of the back links 704. Therefore, shortening the length of the back and head cable 32 causes the back area 104 and the head area 102 to become substantially concave in relation to a user lying on the adjustable mattress frame 1. This embodiment is achieved due to the back links 704 and the head links 702 that comprise the back area 104 and the head area 102, respectively.

Returning now to FIG. 3, according to another embodiment described above, the legs cable 34 is attached to an upper side of the thighs area 110, at the knees area 112 the legs cable 34 changes its orientation to a lower side of the legs area 108, and then the legs cable 34 is attached to a lower side of the shins area 114.

Figure 8:
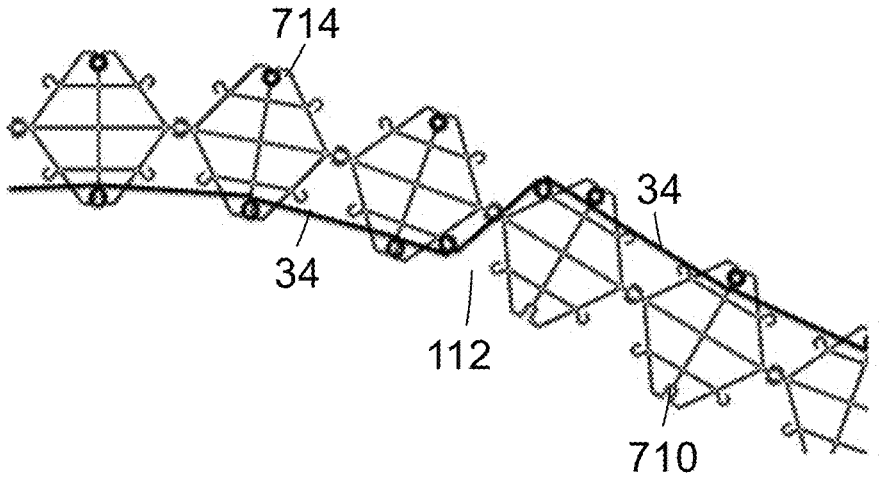
FIG. 8 schematically illustrates, according to some exemplary embodiments, a side view of a legs cable movably connected to legs links.

Returning now to FIG. 7, and referring to FIG. 8, illustrating a side view of a legs cable movably connected to legs links. The legs cable 34 is attached to upper sides of the thighs links 710, at the knees area 112 the legs cable 34 changes its orientation to a lower side of the legs area 108, and then the legs cable 34 is attached to lower sides of the shins links 714. Therefore, shortening the length of the legs cable 34 causes the thighs area 110 to become substantially concave in relation to a user lying on the adjustable mattress frame 1, and the shins area 114 be substantially horizontal, or even somewhat convex in relation to a user lying on the adjustable mattress frame 1, while bending the legs area 108 at the knees area 114. The concaving of the thighs area 110 and convexing of the shins area 114 is achieved due to the thighs link 710 and the shins links 714, respectively.

Figure 9:
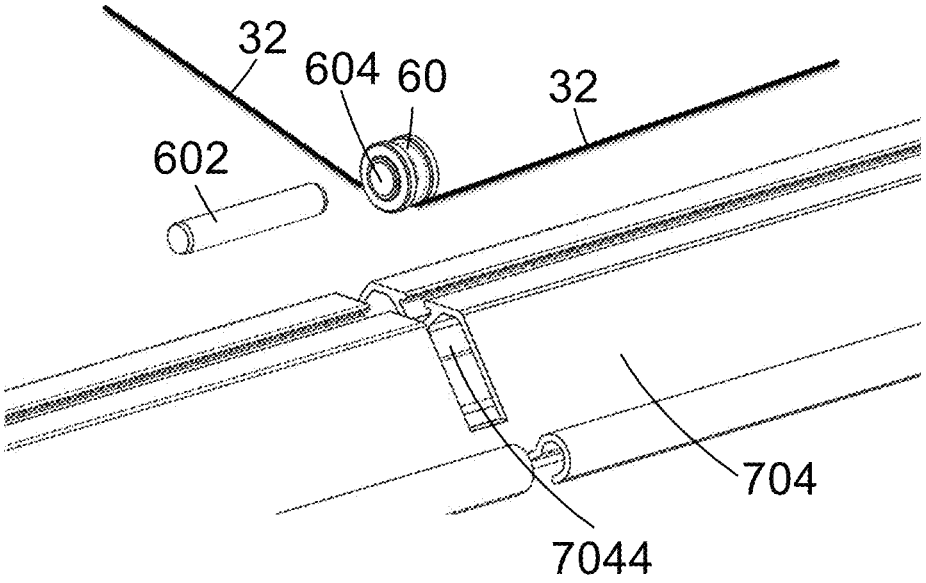
FIG. 9 schematically illustrates, according to some exemplary embodiments, a perspective view of a link and pulley block.

Referring now to FIG. 9, schematically illustrating a perspective view of a link and pulley block. As can be seen in FIG. 8, the link, for example a back link 704, comprises a transverse slot 7044 that is configured to accommodate a pulley block 60. The pulley block 60 is configured to attach to an upper side of the back link 704. For clarity, the pulley block 60 is illustrated outside the transverse slot 7044. Note, that as mentioned above, a lower side of the pulley block 60 is in contact with the back and head cable 32. FIG. 8 additionally illustrates a pin 602 that is configured to be inserted into a hole 604 at a center if the pulley block 60 in order to hold the pulley block 60 in place when accommodated in the transverse slot 7044.

It should be noted that since the back and head cable 32 is attached to the upper sides of the back links 704 and the head links 702, then the pulley blocks 60 are attached to the upper sides of the back links 704 and the head links 702, and the lower sides of the pulley blocks 60 are in contact with the back and head cable 32. Similarly, since the legs cable 34 is attached to the upper sides of the thighs links 710, then the pulley blocks 60 are attached to the upper sides of the thighs links 710, and the lower sides of the pulley blocks 60 are in contact with the legs cable 34. However, since the legs cable 34 is attached to the lower sides of the shins links 714, then the pulley blocks 60 are attached to the lower side of the shins links 714, and the upper side of the pulley blocks 60 are in contact with the legs cable 34.

Returning now to FIG. 6, that further illustrates a back and head adjuster 42 in a form of a back and head rotor 422. The back and hand cable 32 is wrapped around the back and head rotor 422. Similarly, when the legs adjuster 44 is in a form of a legs rotor 442, the legs cable 34 is wrapped around the legs rotor 442. In order to adjust the adjustable mattress frame 1 the lengths of the cables should not be changed to a great extent. For example, in order to maximally concave the head area 102 and back area 104, there is a need to shorten the length of the back and head cable 32 in substantially 8-10 cm. Similarly, the length of the legs cable 34 can be shortened in substantial 8-10 cm in order to achieve maximal bending of the legs area 108. This embodiment is advantageous over prior art adjustable beds, because the rotors can be relatively small and weak, in order to achieve a desired adjustment of parts of the adjustable mattress frame, whereas prior art adjustable beds should comprise heavy and strong motors in order to be able to move the heavy parts of the adjustable bed during adjustment.

Returning now to FIG. 8. The links illustrated in FIG. 8 have a substantially diamond-like profile. However, this is only an exemplary embodiment of the profile of the links, and any shape of the profile of the links that allows changing an angle between two adjacent links is under the scope of the present subject matter. For example a triangular profile.

Figure 10:
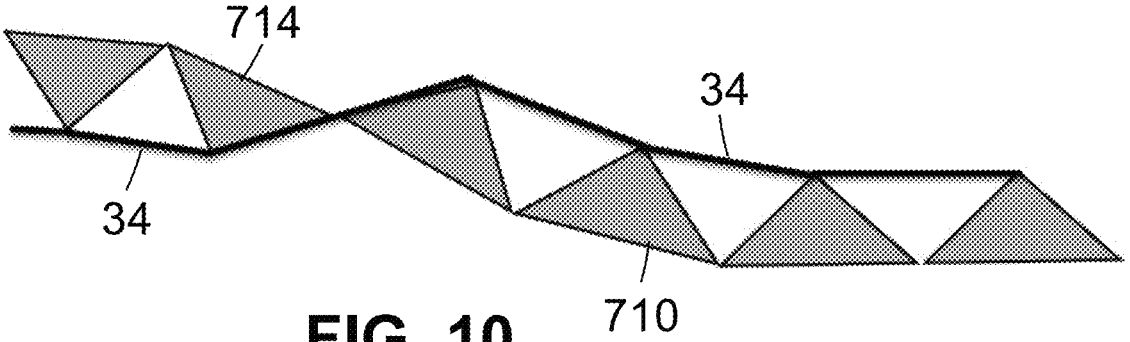
FIG. 10 schematically illustrates, according to some exemplary embodiments, a side view of a legs cable movably attached to legs link having a triangular profile.

Referring now to FIG. 10 schematically illustrating a side view of a legs cable movably attached to legs link having a triangular profile. As shown in FIG. 10, the links can have a triangular profile. Similarly, also the back links 704 and the head links 702 can have a triangular profile. However, when referring to the legs links 708 illustrated in FIG. 10, in order to achieve the bending of the legs area 708 at the knees area 712 by shortening the length of the legs cable 34, the orientation of the thighs links 710 has to be opposite of the profile of the shins links 714. In other words, in a thighs link 710, a base of the triangular profile faces downwards, and a corner of the triangular profile faces upwards. However, the orientation of a shins link 714 is opposite. In the shins link 714, the base of the triangular profile faces upwards and the corner of the triangular profile faces downwards.

According to one embodiment, illustrated in previous drawings, the size of the profile of the links is uniform, namely, all the links of the adjustable mattress frame 1 have a similar size of the profile. However, this embodiment is exemplary and should not be considered as limiting the scope of the present subject matter. According to some other embodiments, the profiles of the links can be different in Size.

Figure 11:
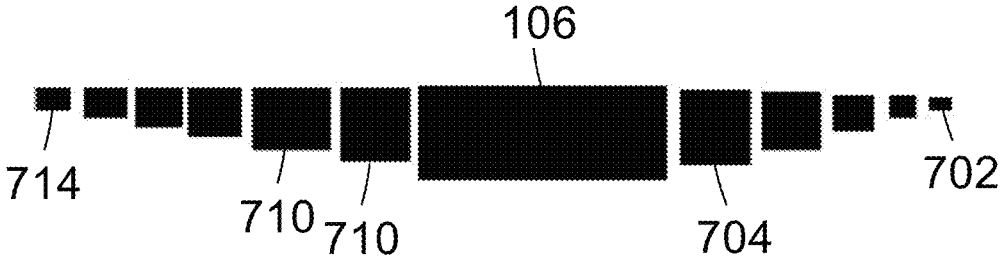
FIG. 11 schematically illustrates, according to some exemplary embodiments, a side view of relative profile sizes of links of an adjustable mattress frame.

Referring now to FIG. 11, schematically illustrating a side view of an exemplary embodiment of relative profile sizes of links of an adjustable mattress frame. According to one embodiment, the profiles of the links are different in size. According to another embodiment, the links that are the closest to the lower back area 106 have a larger profile than links that are more distant from the lower back area 106. According to yet another embodiment, as a distance between a link and the lower back area 106 increases, the size of the profile of the link decreases. According to one embodiment, the lower back area 106 is configured to be in touch with a surface on which the adjustable mattress frame 1 stands. Therefore, most of the weight of the adjustable mattress frame 1, and the weight of the user that lies of the adjustable mattress frame 1, is carried by the lower back area 106. However, as a distance between the lower back area and a part of the adjustable mattress frame 1 increases, a lower weight has to be carried by that part. Therefore, the strength of the link that is most adjacent to the lower back area 106 has to be larger than the strength of links that are more distant from the lower back area 106; and as the distance of a link from the lower back area 106 increases, the strength of the link can be lower. The strength of the link can be reflected in the size of the profile of the link, namely a large profile confers high strength to the link, and a lower profile confers lower strength to the link. This explain the aforementioned embodiments regarding the sizes of the profiles of the links. These embodiments, of links having different sizes of profile are advantageous over prior art adjustable beds, since they can reduce the weight and cost of the adjustable mattress frame 1, because less material is needed is needed for the manufacturing of the adjustable mattress frame 1. Of course, these embodiments are applicable with the adjustable mattress frame 1 of the present subject matter, and not with prior art adjustable beds.

Figure 12A:
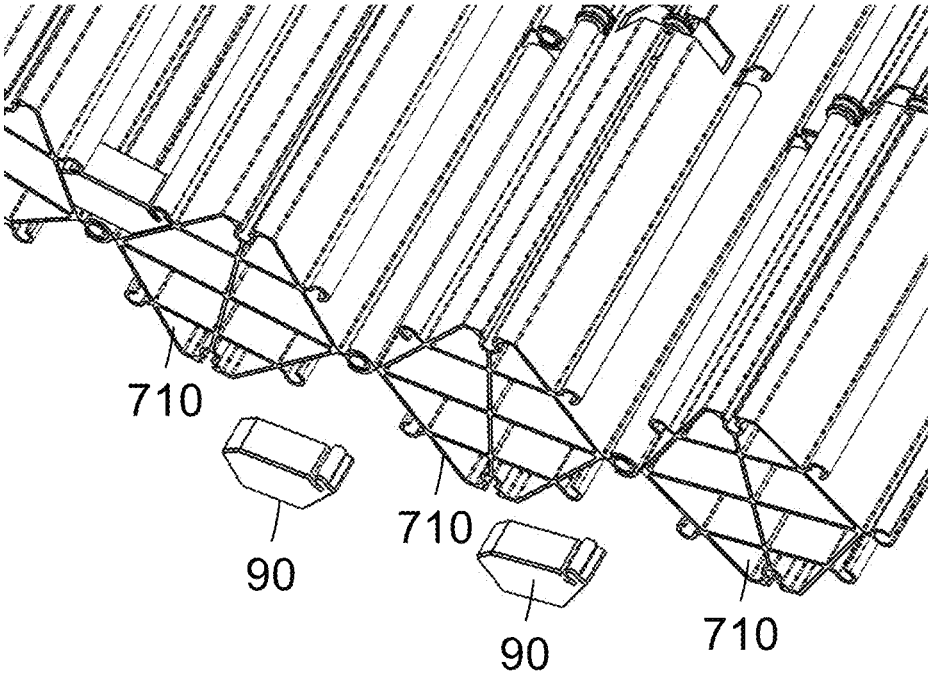
FIGS. 12A-B schematically illustrate, according to some exemplary embodiments, a side perspective view of a part of an adjustable mattress frame further comprising at least one spacer.
Figure 12B:
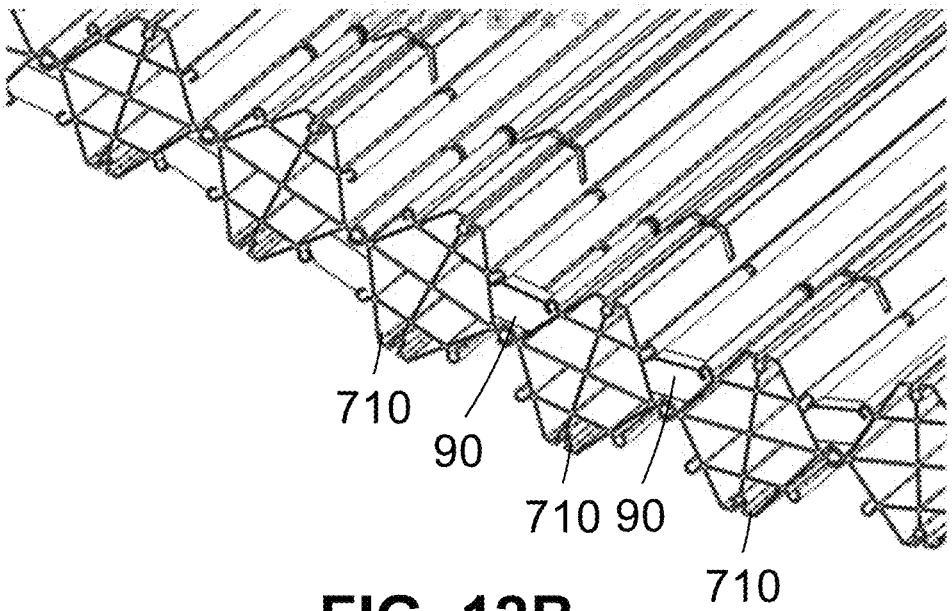

Referring now FIGS. 12A-B, schematically illustrating a side perspective view of a part of an adjustable mattress frame further comprising at least one spacer. According to one embodiment, the adjustable mattress frame further comprises at least one spacer 90 configured to be attached between two adjacent links and determine a minimal angle that can be adjusted between two adjacent links during adjustment of the adjustable mattress frame 1. FIG. 12A illustrates two spacers 90 separated from the adjustable mattress frame, and FIG. 12B illustrates the two spacers 90, each attached between two adjacent links, for example two adjacent thighs links 710. According to one embodiment, the shape of the spacer 90 corresponds to a shape of a space between two adjacent links. Thus, in the embodiment illustrated in FIGS. 12A-B, the shape of the space between two adjacent links is substantially triangular, and therefore the shape of the spacers 90 is substantially triangular. According to another embodiment, the spacers 90 are configured to removably attach between two adjacent links. This embodiment allow attachment of spacers 90 in different sizes, and thus allow various degrees of maximal curvature of the adjustable mattress frame 1. The smaller the spacer is, the smaller is the maximal angle that can be adjusted between two adjacent links to which the spacer 90 is attached; and as the maximal angle between two adjacent links is smaller, the curvature of the adjustable mattress frame is higher.

According to one embodiment, the adjustable mattress frame 1 comprises at least one angle changer 30 that is movably attached to the areas of the adjustable mattress frame 1, the angle changer 30 is configured to change its length, thereby configured to change an angle between two adjacent area. According to another embodiment, the angle changer 30 is movably attached to multiple links, for example a cable. The aforementioned back and head cable 32, and the legs cable 34, are exemplary angle changers 30 that are movably attached to the areas of the adjustable mattress frame 1, as described above, or movably attached to multiple links. Changing the length of the angle changer 30 that is movably attached to multiple links changes the angles between any two adjacent links that are movably attached to the angle changer 30. An advantage of this embodiment is that it allows changing the angles between multiple two adjacent links simultaneously.

According to a further embodiment, the angle changer 30 is attached to two adjacent links. Thus, at least some, preferably all two adjacent links, are each movably attached to an angle changer 30. An advantage of this embodiment is that it allows changing an angle between two adjacent links independently of any other two adjacent links in the adjustable mattress frame 1. Another advantage of this embodiment is that it nullifies the need for the aforementioned back and head adjuster 42, and/or a legs adjuster 44. Each angle changer 30 movably attached to two adjacent links is configured to change its length, either by itself, or by an adjuster that is connected to the angle changer 30 movably attached to two adjacent links. An additional advantage of this embodiment is that it allows endless variations of adjustment of the adjustable mattress frame 1. Since every two adjacent links are independent of other two adjacent links, each two adjacent links can assume a different angle between them, and therefore endless variations of the shape of the adjustable mattress frame 1 can be obtained. Furthermore, coordinate changing of the angle between the links can have a movement effect of the adjustable mattress frame 1. Thus, the adjustable mattress frame 1 can also provide a massaging effect for a user of the adjustable mattress frame 1. FIGS. 13A-D illustrate some exemplary embodiments of an angle changer 30 that is movably attached to two adjacent links.

Figure 13A:
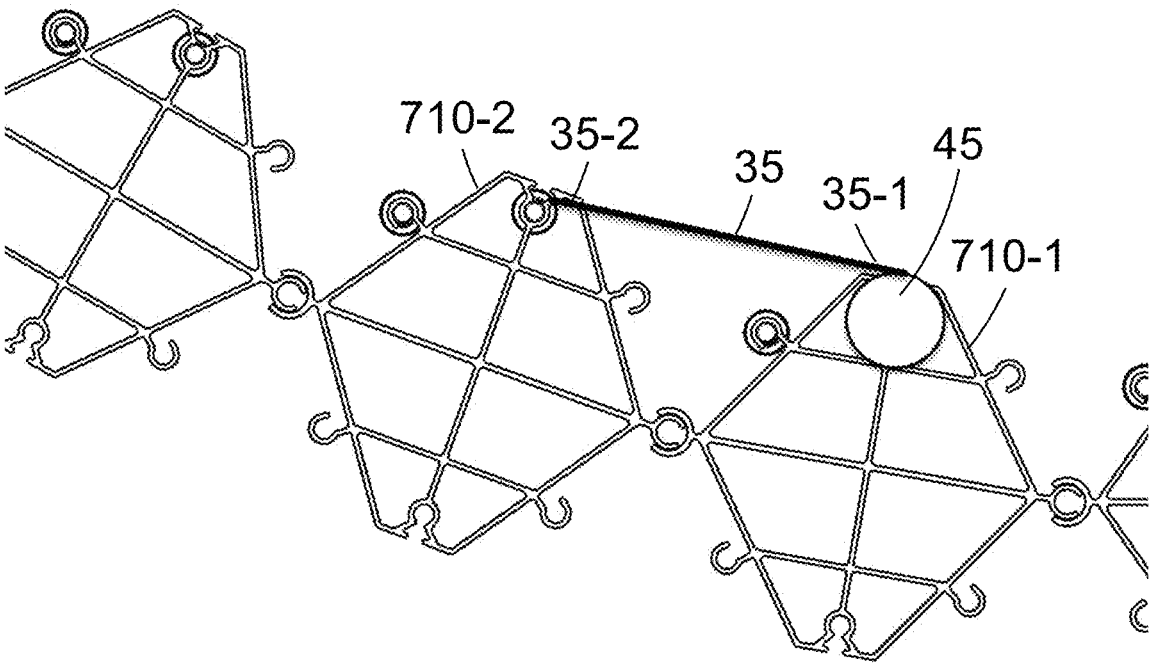
FIGS. 13A-D schematically illustrate, according to some exemplary embodiments, a side view of an angle changer that is movably attached to two adjacent links.

Referring now to FIG. 13A, schematically illustrating a side view of an angle changer in a form of a short cable. As can be seen in FIG. 13A, two adjacent links are shown, for example two adjacent thighs links 710. It should be noted that this embodiment relates to any type of link of the present subject matter, and the two adjacent thighs links 710 are described for the purpose of illustration of this embodiment. The two adjacent thighs link 710 are designated "first thighs link 710-2" and "second thighs link 710-2.

FIG. 13A illustrates an angle changer 30 in a form of a link cable 35, and a link rotor 45. The link rotor 45 is attached to the first thighs link 710-1. In addition, a first end 35-1 of the link cable 35 is wrapped around the link rotor 45, and a second end 35-2 of the link cable 35 is attached to the second thighs link 710-2. Rotation of the link rotor 45 in one direction, for example clockwise, causes shortening of the part of the link cable 35 that connects the first thighs link 710-1 and the second thighs link 710-2, while rotation of the link rotor 45 in an opposite direction, for example counter-clockwise, allow increasing the length of the part of the link cable 35 that connects the first thighs link 710-1 and the second thighs link 710-2. Shortening of the link cable 35 causes decrease of an angle A between the first thighs link 710-1 and the second thighs link 710-2, while increasing the length of the link cable 35 causes increases the angle A between the first thighs link 710-1 and the second thighs link 710-2.

Figure 13B:
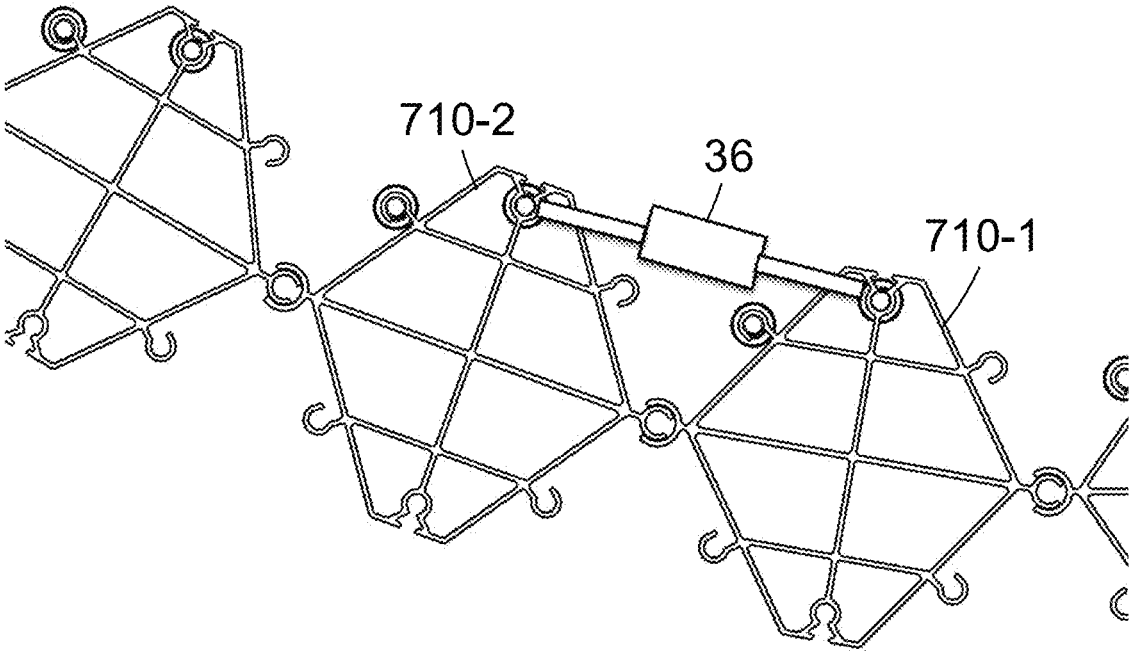
Figure 13C:
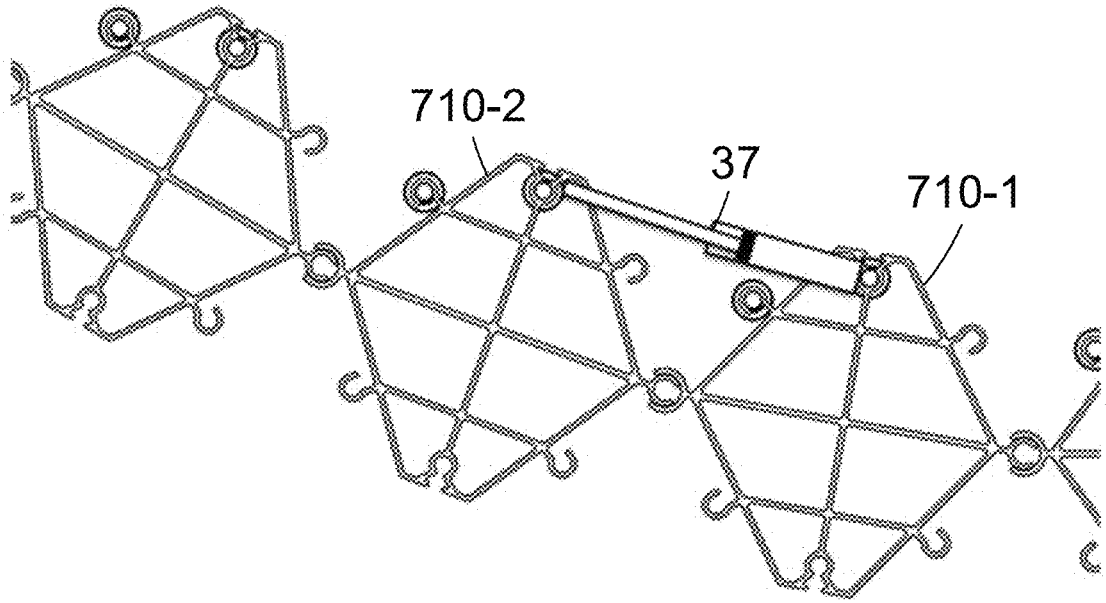

Referring now to FIGS. 13B-C schematically illustrating a side view of two embodiments of an angle changer in a form of a piston. FIG. 13B illustrates an angle changer in a form of a double-sided piston 36, and FIG. 13C illustrates an angle changer 30 in a form of a single-sided piston 37. The piston is movably attached to two adjacent links, for example to the first thighs link 710-1 and the second thighs link 710-2. Shortening the length of the piston decreases the angle A between the first thighs link 710-1 and the second thighs link 710-2, while increasing the length of the piston increases the angle A between the first thighs cable 710-1 and the second thighs link 710-2.

Figure 13D:
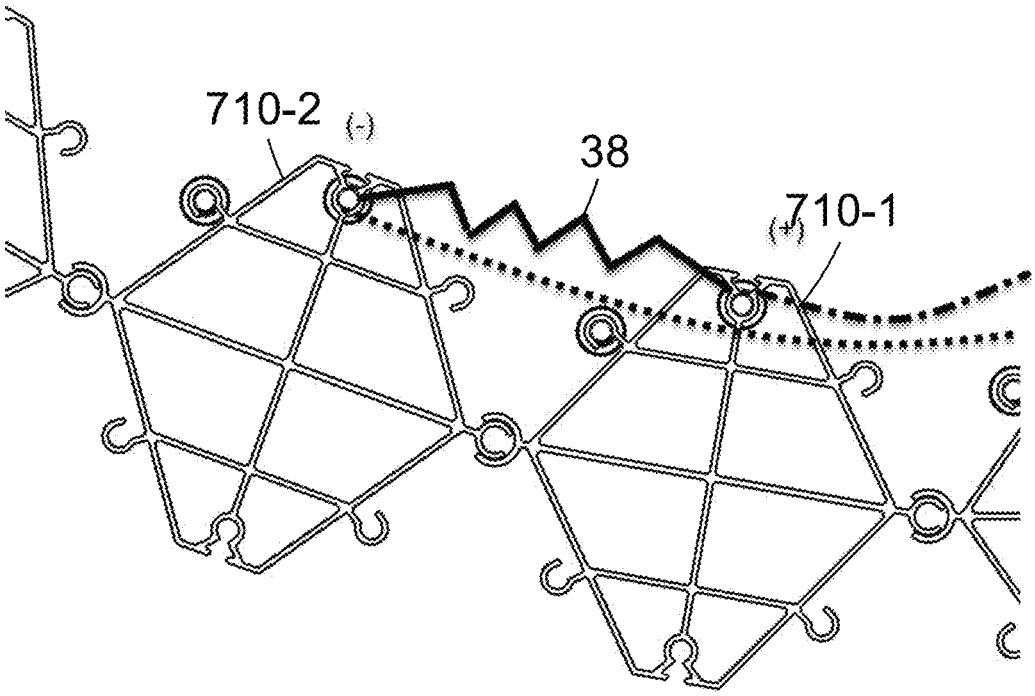

Referring to FIG. 13D, schematically illustrating a side view of an angle changer in a form of a nitinol spring. As shown in FIG. 13D, the nitinol spring 38 is movably attached to two adjacent links, for example he first thighs link 710-1 and the second thighs link 710-2. The length of the nitinol spring 38 can be shortened by heating of the nitinol spring 38, for example by transferring an electric current through the nitinol spring 38; and the length of the nitinol spring 38 can be shortened by cooling the nitinol spring 38, or letting the nitinol spring 38 to passively cool, for example by stopping the transfer of electric current through the nitinol spring 38. Shortening the length of the nitinol spring 38 decreases the angle A between the first thighs link 710-1 and the second thighs link 710-2, while increasing the length of the nitinol spring 38 increases the angle A between the first thighs cable 710-1 and the second thighs link 710-2.

Figure 14:
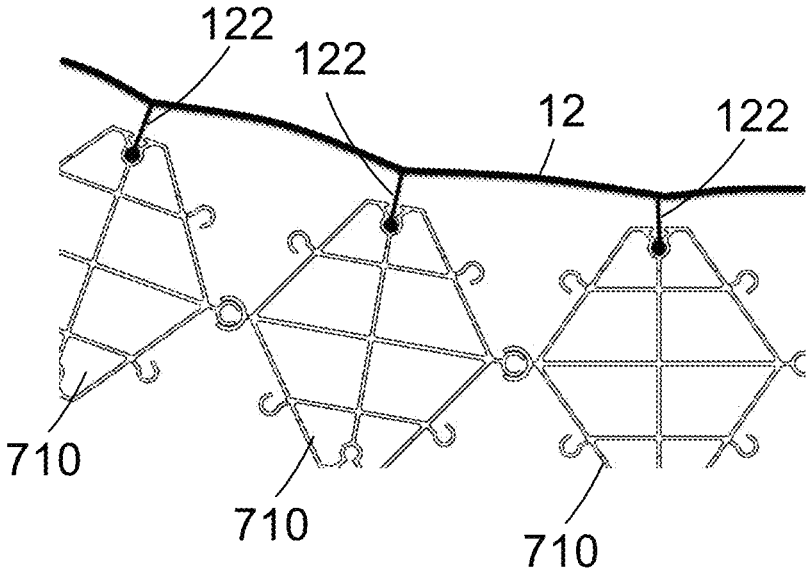
FIG. 14 schematically illustrates, according to some exemplary embodiments, a side view of links covered with a cover.

Referring now to FIG. 14, schematically illustrating a side view of links covered with a cover. According to one embodiment, the adjustable mattress frame 1 can be used as is, namely a user can lie directly on the adjustable mattress frame 1. According to a preferred embodiment, the adjustable mattress frame 1 comprises a cover 12 configured to cover the adjustable mattress frame 1 in order to provide more comfort for the user that lies on the adjustable mattress frame 1. According to one embodiment, the cover 12 is elastic, and can be made of an elastic material, for example rubber, silicon, elastic plastic and the like. Since the adjustable mattress frame 1 changes its shape, and in some embodiments changes its shape continuously, for example during massaging, the elastic cover 12 is configured to change its shape according to a shape of the adjustable mattress frame. According to another embodiment, the cover 12 is robust. In other words, the cover 12 is configured to withstand pressure from a weight of a user that lies on the cover 12, and withstand possible damage by sharp parts of the adjustable mattress frame 1, for example sharp edges of links and the like. According to yet another embodiment, the cover 12 is movably attached to the links of the adjustable mattress frame 1. As can be seen in FIG. 14, a cover connector 122 attached to cover 12 can be pivotally attached to a link. Thus, according to one embodiment, the cover 12 further comprises multiple cover connectors 122, each cover connector 122 is configured to pivotally attach to a link. The pivotal attachment of the cover connector 122 to the link facilitates adjustment of the shape of the cover 12 to the shape of the adjustable mattress frame 1. In addition, the connection of the cover 12 to the links keeps the cover 12 in place, and prevents slippage of the cover 12 over the adjustable mattress frame 1.

Figure 15:
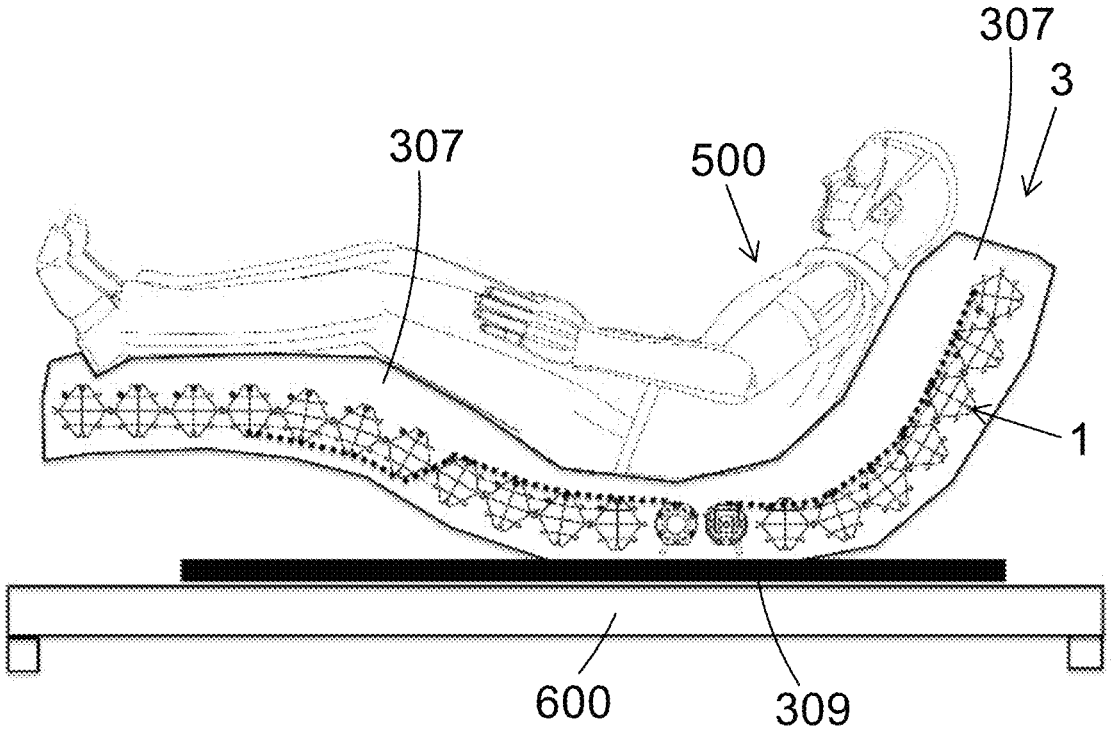
FIG. 15 schematically illustrates, according to some exemplary embodiments, a side see-through view of an adjustable mattress comprising an adjustable mattress frame.

Referring now to FIG. 15 schematically illustrating a side see-through view of an adjustable mattress comprising an adjustable mattress frame. According to another preferred embodiment, the adjustable mattress frame 1 is configured to serve as an inner frame of an adjustable mattress 3. Thus, the present subject matter provides an adjustable mattress 3 comprising an inner mattress frame 1, according to embodiments described herein. According to one embodiment, the adjustable mattress frame 1 is padded with a padding material 307 used in the art of mattresses. According to another embodiment, the adjustable mattress frame 1 is covered with the cover 12 illustrated in FIG. 14, according to embodiments described above, and further padded with a padding material 307. According to a further embodiment, the padding material 307 is configured to change its shape according to a shape of the adjustable mattress frame.

According to one embodiment, the adjustable mattress is configured to be placed on a surface, for example, a bed 600 as illustrated in FIG. 15, a floor, and the like. As further illustrated in FIG. 15, the adjustable mattress 3 can further comprise a base 309, configured to be placed on the surface, for example a bed 600, while the adjustable mattress 3 is placed on the base 309.

It is appreciated that certain features of the subject matter, which are, for clarity, described in the context of separate embodiments, may also be provided in combination in a single embodiment. Conversely, various features of the subject matter, which are, for brevity, described in the context of a single embodiment, may also be provided separately or in any suitable sub combination.

Although the subject matter has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The invention claimed is:

1. An adjustable mattress frame configured to support a human user lying on the adjustable mattress frame, the adjustable mattress frame comprising:

a lower back area configured to support a lower back of the user, and be in contact with a surface on which the adjustable mattress frame is placed; and either an upper area configured to support an upper part of a body of the user, pivotally connected to the lower back area; or a legs area configured to support legs of the user-pivotally, pivotally connected to the lower back area; or both the upper area and the legs area, wherein the upper area comprises: a head area configured to support a head of the user, pivotally connected to a back area configured to support a back of the user, pivotally connected to the lower back area, and wherein the legs area comprises: a thighs area configured to support thighs of the user, pivotally connected to the lower back area, and a shins area configured to support shins of the user, pivotally connect to the thighs area, wherein a pivot area between the thighs area and the shins area is a knees area configured to support knees of the user, and wherein the adjustable mattress frame further comprises at least one angle changer movably attached to the areas of the adjustable mattress frame, and configured to change its length, thereby configured to change an angle between two adjacent areas, wherein the adjustable mattress frame further comprising multiple elongated pivotally connected links, wherein the links are head links, back links, thighs links and shin links, wherein the head area comprises the head links, wherein a length of the head link determines a width of the head area;

the back area comprises the back links, wherein a length of the back link determines a width of the back area;

the thighs area comprises the thighs links, wherein a length of the thighs links determines a width of the thighs area;

the shins area comprises the shins links, wherein a length of the shins link determines a width of the shins area;

wherein the at least one angle changer is movably attached to the links, and configured to change its length, thereby configured to change an angle between two adjacent links, and wherein the adjustable mattress frame further comprising at least one spacer configured to be attached between two adjacent links and determine a minimal angle that can be adjusted between two adjacent links during adjustment of the adjustable mattress frame.

2. The adjustable mattress frame of claim 1, wherein the angle changer is a back and head cable fixedly attached to the head area, and movably attached to the back area, and further attached to a back and head adjuster positioned in the lower back area, and configured to change the length of the back and head cable, wherein changing the length of the back and head cable changes an angle between the head are and the back area, and an angle between the back area and the lower back area.

3. The adjustable mattress frame of claim 1, wherein the angle changer is a legs cable fixedly attached to the shins area, and movably attached to the thighs area, and further attached to a legs adjuster positioned in the lower back area, and configured to change the length of the legs cable, wherein changing the length of the legs cable changes an angle between the shins area and the thighs area, and an angle between the thighs area and the lower back area.

4. The adjustable mattress frame of claim 1, wherein the angle changer is a back and head cable fixedly attached to a head link, movably attached to other head links, movably attached to back links, and further attached to a back and head adjuster positioned in the lower back area, and configured to change the length of the back and head cable, wherein changing the length of the back and head cable changes an angle between two adjacent head links, and an angle between the head area and the back area, and an angle between two adjacent back links, and an angle between the back area and the lower back area.

5. The adjustable mattress frame of claim 1, wherein the angle changer is a legs cable fixedly attached to a shins link, movably attached to other shins links, movably attached to thighs links, and further attached to a back and head adjuster positioned in the lower back area, and configured to change the length of the legs cable, wherein changing the length of the legs cable changes an angle between two adjacent shins links, and an angle between the shins area and the thighs area, and an angle between two adjacent thighs links, and an angle between the thighs area and the lower back area.

6. The adjustable mattress frame of claim 1, wherein the angle changer is movably attached to two adjacent links, and is configured to change its length, thereby configured to change an angle between the two adjacent links.

7. The adjustable mattress frame of claim 6, wherein every two links are movably attached with an angle changer.

8. The adjustable mattress frame of claim 7, wherein every angle changer is independent of any other angle changer, thereby allowing changing an angle between any two adjacent links differently of any other two adjacent links.

9. The adjustable mattress frame claim 1, further comprising a cover configured to cover the adjustable mattress frame.

10. The adjustable mattress frame of claim 9, wherein the cover is configured to change its shape according to a shape of the adjustable mattress frame.

11. The adjustable mattress frame of claim 9, wherein when a user is placed on the cover the cover withstands possible damage by sharp parts of the adjustable mattress frame.

12. The adjustable mattress frame of claim 9, wherein the cover is movably attached to the links.

13. The adjustable mattress frame of claim 12, wherein the cover comprises multiple cover connectors, and wherein each cover connector is configured to pivotally attach to a link.

14. An adjustable mattress comprising an inner adjustable mattress frame according to claim 13.

15. The adjustable mattress of claim 14, wherein the adjustable mattress frame is covered with a padding material.

16. The adjustable mattress frame of claim 15, wherein the padding material is configured to change its shape according to a shape of the adjustable mattress frame.

17. The adjustable mattress frame of claim 1, wherein the at least one spacer is configured to removably attach between the two adjacent links.

* * * * *